US012446688B2

(12) United States Patent
Sagel

(10) Patent No.: US 12,446,688 B2
(45) Date of Patent: Oct. 21, 2025

(54) PULL-OUT RACK FOR A KITCHEN CABINET

(71) Applicant: Vauth-Sagel Holding Gmbh & Co. KG, Brakel (DE)

(72) Inventor: Claus Sagel, Bielefeld (DE)

(73) Assignee: Vauth-Sagel Holding GmbH & Co. KG, Brakel (DE)

( * ) Notice: Subject to any disclaimer, the term of this patent is extended or adjusted under 35 U.S.C. 154(b) by 199 days.

(21) Appl. No.: 18/144,483

(22) Filed: May 8, 2023

(65) Prior Publication Data

US 2024/0374025 A1 Nov. 14, 2024

(51) Int. Cl.

| | |
|---|---|
| ***A47B 88/40*** | (2017.01) |
| ***A47B 88/407*** | (2017.01) |
| ***A47B 88/427*** | (2017.01) |
| ***A47B 88/437*** | (2017.01) |
| ***A47B 88/477*** | (2017.01) |

(52) U.S. Cl.

CPC ..... *A47B 88/407* (2017.01); *A47B 88/427* (2017.01); *A47B 88/437* (2017.01); *A47B 88/477* (2017.01)

(58) Field of Classification Search

CPC ..... A47B 88/42; A47B 88/407; A47B 88/427; A47B 88/437; A47B 88/477; A47B 2210/0091; A47B 2088/422

USPC ..... 312/331, 334.27

See application file for complete search history.

(56) References Cited

U.S. PATENT DOCUMENTS

| | | | | | |
|---|---|---|---|---|---|
| 3,129,988 | A * | 4/1964 | Kanzelberger | A47B 88/497 | 312/334.24 |
| 3,160,448 | A * | 12/1964 | Abernathy | A47B 88/483 | 312/334.7 |
| 3,836,223 | A * | 9/1974 | Signore | A47B 88/433 | 312/334.14 |
| 5,118,177 | A * | 6/1992 | Ryczek | A47B 88/487 | 312/334.26 |
| 5,795,044 | A * | 8/1998 | Trewhella, Jr. | A47B 88/57 | 292/87 |
| 6,142,596 | A * | 11/2000 | Carson | A47B 88/487 | 312/330.1 |
| 7,204,569 | B2 | 4/2007 | Walburn | | |
| D596,424 | S | 7/2009 | Noe | | |
| 8,091,971 | B2 | 1/2012 | Ward | | |
| 8,388,076 | B2 | 3/2013 | Walburn | | |
| 8,419,080 | B2 * | 4/2013 | Levine | A47B 95/00 | 292/87 |

(Continued)

*Primary Examiner* — James O Hansen

(74) *Attorney, Agent, or Firm* — Thomas | Horstemeyer, LLP

(57) ABSTRACT

A pull-out rack for being mounted in a cabinet having a bottom wall, a pair of side walls and a front frame enclosing a front opening and protruding inwards from the side walls comprises a pull-out rail, a rack body and a pair of stabilizers. The rack body is mounted to the bottom wall via the pull-out rail, is configured to pass through the front opening, and has a vertically oriented back panel with an upper end. Each stabilizer of the pair of stabilizers has a mounting end and a moving contact end, and each stabilizer of the pair of stabilizers is designed to be mounted to the upper end of the back panel of the rack body with its mounting end in a working position in which its moving contact end laterally protrudes from the back panel and contacts one of the side walls of the cabinet.

16 Claims, 9 Drawing Sheets

(56) References Cited

U.S. PATENT DOCUMENTS

| | | | | |
|---|---|---|---|---|
| 8,733,865 | B1 | 5/2014 | Chambers | |
| 8,939,526 | B1 | 1/2015 | Chambers | |
| 9,049,930 | B1 | 6/2015 | Chambers | |
| 9,756,941 | B1 | 9/2017 | Rowland | |
| 10,799,020 | B1 * | 10/2020 | Tingle | A47B 46/00 |
| 2006/0091768 | A1 | 5/2006 | Walburn | |
| 2006/0250059 | A1 * | 11/2006 | Lemm | A47B 88/467<br>312/331 |
| 2017/0258226 | A1 | 9/2017 | Rowland | |

* cited by examiner

PULL-OUT RACK FOR A KITCHEN CABINET

FIELD OF THE INVENTION

The present invention generally relates to a pull-out rack comprising at least one pull-out rail and a rack body. More particular, the present invention relates to a pull-out rack for a cabinet having a bottom wall, a pair of side walls and a front frame enclosing a front opening and protruding inwards from the side walls. The cabinet may be a kitchen cabinet.

BACKGROUND OF THE INVENTION

The rack body of a pull-out rack mounted in a cabinet may, at least partially, be pulled out of the cabinet in order to gain access to objects arranged in or on the rack body for being stored in the cabinet. A good handling of the pull-out rack requires that it smoothly runs out of the cabinet and back into the cabinet even if loaded with the weight of a lot of objects. At the same time, the pull-out rack should be mountable in the cabinet in an easy way, i.e. to the bottom wall of the cabinet only. Such a bottom side-only support of the pull-out rack at the cabinet is particularly soft or weak with respect to the stabilization of the upper part of the rack body. This particularly applies, if the rack body is mounted to the bottom wall of the cabinet via a single pull-out rail or a pair of pull-out rails arranged at a small lateral distance, which is the case with slim rack bodies having a width of only 10 inch, 8 inch, 6 inch or even less.

With cabinets, particularly with kitchen cabinets of that type having a bottom wall, a pair of side walls and a front frame enclosing a front opening and protruding inwards from the side walls, it is known to attach stabilizing elements to inside facing areas of the front frame which abut against rails of the rack body extending in the pull-out direction of the pull-out rack. These stabilizing elements have a felt or plastic surface sliding along the rails, and laterally stabilize the upper part of the rack body during its pull-out movement and in its fully pulled-out position. It is complicated to arrange these stabilizing elements in such a way that they laterally stabilize the rack body during its pull-out movement without lateral play but do not hinder this pull-out movement by excessive friction. Further, the stabilizing elements tend to leave marks on the rails against which they abut.

Thus, there is a need of a pull-out rack which is easily mounted in a cabinet but whose rack body is nevertheless well stabilized in lateral direction even if it is of a small width only.

SUMMARY OF THE INVENTION

The present invention relates to a pull-out rack for a cabinet having a bottom wall, a pair of side walls and a front frame enclosing a front opening and protruding inwards from the side walls. The pull-out rack comprises at least one pull-out rail, a rack body and a pair of stabilizers. The at least one pull-out rail has a fixed rail and a guided rail. The fixed rail is configured to be mounted to the bottom wall of the cabinet. The guided rail is linearly guided in a pull-out direction with respect to the fixed rail. The rack body is mounted to the guided rail of the at least one pull-out rail, is configured to pass through the front opening, and has a vertically oriented back panel with an upper end. Each stabilizer of the pair of stabilizers has a mounting end and a moving contact end, and each stabilizer of the pair of stabilizers is configured to be mounted to the upper end of the back panel of the rack body with its mounting end being in a working position in which its moving contact end laterally protrudes from the back panel and contacts one of the side walls of the cabinet.

The present invention also relates to a pull-out rack for a cabinet having a bottom wall, a pair of side walls and a front opening. Said pull-out rack also comprises at least one pull-out rail and a rack body. The at least one pull-out rail has a fixed rail and a guided rail. The fixed rail is configured to be mounted to the bottom wall of the cabinet, and the guided rail is linearly guided in a pull-out direction with respect to the fixed rail. The rack body is mounted to the guided rail of the at least one pull-out rail and configured to pass through the front opening. The rack body comprises a vertically oriented back panel, a vertically oriented front panel arranged at a horizontal distance to the back panel, a bottom shelf, a top shelf and at least one intermediate shelf. The back panel comprises at least two vertical rows of blind holes in its front side, and the front panel comprises at least two vertical rows of the blind holes in its back side. Each of the shelves extends between the front side of the back panel and the back side of the front panel and has a shelf panel and a pair of bent metal sheets fixed to the shelf panel. The bent metal sheets enclose those edges of the shelf panel that extend between the back panel and the front panel, and upwardly protrude beyond the shelf panel. Back connecting screws are screwed through the back panel into the bottom and the top shelf panels, and front connecting screws are screwed through the front panel into the bottom and the top shelf panels. A pair of back supporting pins fitting into two of the blind holes in the front side of the back panel and a pair of front supporting pins fitting into two of the blind holes in the back side of the front panel vertically support the at least one intermediate shelf. The supporting pins fit into seats at a bottom side of the at least one intermediate shelf. The seats are laterally delimited by upwardly or downwardly bent sections of the bent metal sheets of the at least one intermediate shelf.

The present invention also relates to a pair of stabilizers for a pull-out rack having a bottom and a vertically oriented back panel with an upper end and mounted in a cabinet having a bottom wall, a pair of side walls and a front frame enclosing a front opening and protruding inwards from the side walls via at least one pull-out rail having a fixed rail mounted to the bottom wall of the cabinet and a guided rail mounted to the bottom of the pull-out rack. Each stabilizer of the pair of stabilizers comprises a mounting end and a moving contact end. Each stabilizer of the pair of stabilizers is configured to be attached to the upper end of the back panel of the pull-out rack with its mounting end such as to be laterally slidable with respect to the back panel into a working position in which its moving contact end laterally protrudes from the back panel and contacts one of the side walls of the cabinet, and to be fixed to the back panel in the working position. Each stabilizer of the pair of stabilizers has a stabilizer arm extending from its mounting end towards its moving contact end, and a roller having an elastic roller shell and mounted to the stabilizer arm at the moving contact end such as to freely rotate about a vertical axis and to contact the side wall in the working position of the stabilizer. Further, each stabilizer of the pair of stabilizers has an impact damper which is arranged at a front side of the stabilizer laterally protruding from the back panel in the working position of the stabilizer, and which is configured to dampen an impact of the stabilizer on the front frame. The impact damper comprises a front contact element arranged to impact on the front frame, and a spring element elastically supporting the front contact element at the mounting end. The contact element, the spring element and the mounting end may be different areas of a one-part shaped body made of plastic.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
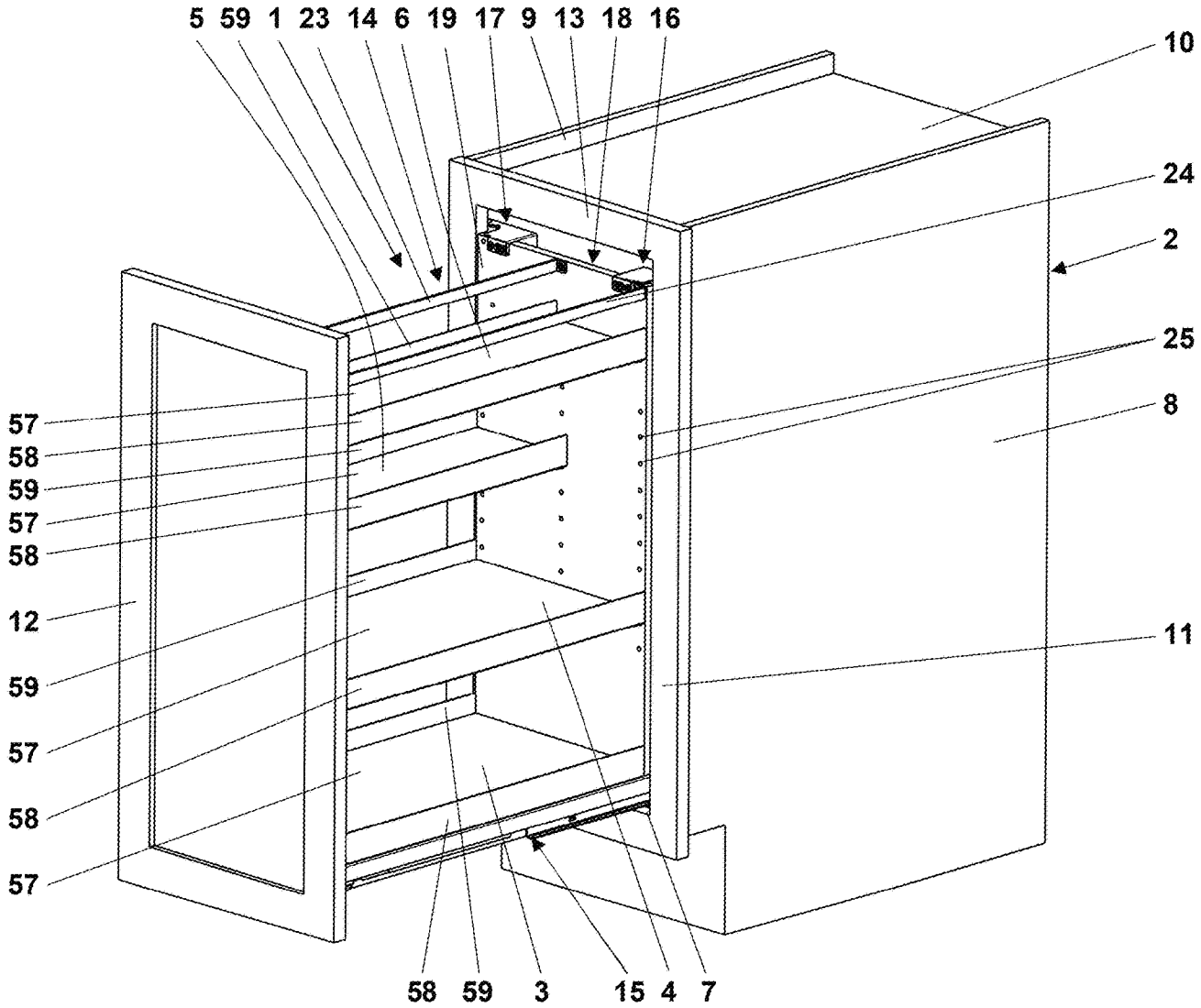
FIG. 1 is an isometric perspective front view of a cabinet with a pulled-out pull-out rack.

The pull-out rack according to the present disclosure is destined for being mounted in a cabinet having a bottom wall, a pair of side walls and a front frame. The front frame encloses a front opening and protrudes inwardly from the side walls. The cabinet may be a kitchen cabinet. The pull-out rack comprises at least one pull-out rail and a rack body. The at least one pull-out rail has a fixed rail and a guided rail. The fixed rail is configured to be mounted to the bottom wall of the cabinet, and the guided rail is linearly guided in a pull-out direction with respect to the fixed rail. Often, the at least one pull-out rail will have an additional intermediate rail which extends the path over which the guided rail may be pulled out in the pull-out direction with respect to the fixed rail. In other words, the at least one pull-out rail may be a so-called full pull-out rail.

The rack body is mounted to the guided rail of the at least one pull-out rail. If the rack body only has a small width, it may be mounted to the guided rail of a single pull-out rail. Typically, there will be two or even more pull-out rails, and the rack body will be mounted to the guided rails of these two pull-out rails which are arranged at a lateral distance. With two or even more pull-out rails the fixed rails may be mounted to a fixed bracket configured to be mounted to the bottom wall of the cabinet. Additionally or alternatively, the guided rails may be mounted to a guided bracket to which the rack body is mounted. The rack body is of such a vertical cross section that it passes through the front opening of the front frame of the cabinet. The rack body has a vertically oriented back panel which has an upper end. In order to laterally stabilize this upper end of the back panel and, thus, the entire rack body over its entire path through the front opening and out of the cabinet, a pair of stabilizes is provided. Each stabilizer of the pair of stabilizers has a mounting end and a moving contact end, and each stabilizer of the pair of stabilizers is configured to be mounted to the upper end of the back panel of the rack body with its mounting end, the respective stabilizer being in a working position. This working position of the stabilizer is defined in that its moving contact end laterally protrudes from the back panel and contacts one of the side walls of the cabinet. Thus, the stabilizer laterally supports the upper end of the back panel of the rack body at this side wall. With the rack body being pulled out of the cabinet, the contact point of the moving contact end of the stabilizer moves along the side wall. With extended use of the pull-our rack, the moving contact end may leave marks on the side wall but these marks are invisible as they are hidden within the cabinet.

It is to be understood that one stabilizer of the pair of stabilizers of the pull-out rack stabilizes the upper end of the back panel of the rack body at the one side wall, whereas the other stabilizer of the pair stabilizers stabilizes the upper end of the rack body at the other side wall. The two stabilizers of the pair of stabilizers may be mirror symmetric with respect to one another.

Further, it is to be understood, that the pair of stabilizers stabilize the upper end of the back panel of the rack body at the side walls of the cabinet independently of the design of the front frame of the cabinet. The cabinet may even have no front frame at all.

The feature that the fixed rail of the at least one pull out rails is configured to be mounted to the bottom wall of the cabinet means may be implemented in that the fixed rail is configured to be actually screwed or otherwise directly fixed to at least one of the bottom wall and a lower part of one of the sidewalls. Alternatively or additionally, the fixed rail may configured to be actually screwed or otherwise directly fixed to a mounting block or fixed bracket which is in turn configured to be screwed or otherwise directly fixed to at least one of the bottom wall and a lower part of one of the sidewalls. Typically, the fixed rail, when mounted to the bottom wall of the cabinet, is supported at the bottom wall at least in vertical direction.

Each stabilizer of the pair of stabilizers may be configured to be attached to the upper end of the back panel of the rack body with its mounting end such as to be laterally slidable with respect to the back panel into its working position. Once the respective stabilizer has been slid along the upper end of the back panel into its working position, it may be fixed to the back panel by, for example, screwing a fixing screw through a circular fixing hole in the mounting end of the stabilizer into the back panel.

Each stabilizer of the pair of stabilizers may have a stabilizer arm extending from its mounting end towards its moving contact end, and a roller mounted to the stabilizer arm at the moving contact end such as to freely rotate about a vertical axis and to contact the side wall in the working position of the stabilizer. In other words, the moving contact end of the stabilizer contacting the side wall is the shell of the roller which does not slide but rolls over the respective side wall.

The movement of the moving end of the stabilizer over the respective side wall will be particularly silent, if the roller of each stabilizer has a soft elastic roller shell.

Each stabilizer of the pair of stabilizers may additionally have an impact damper. This impact damper is arranged at a front side of the stabilizer laterally protruding from the back panel in the working position of the stabilizer. The impact damper is configured to dampen an impact of the stabilizer on the front frame. The at least one pull-out rail mounted to the bottom wall of the cabinet provides a stop for the rack body in the pull-out direction only at the bottom of the rack body. Often, there is no stop for the top of the rack body. In this case, a movement of the rack body only stopped by the at least one pull-out rail at its bottom results in a high bending stress to the at least one pull-out rail. This bending stress is reduced by the stabilizers of the pull-out rack according to the present disclosure in that they abut or lean against the front frame of the cabinet. The impact dampers are provided to avoid a hard impact when the stabilizers get into contact with the front frame.

In an embodiment, each impact damper comprises a front contact element arranged to impact on or get into contact with the front frame, and a spring element elastically supporting the front contact element at the mounting end. In this embodiment, the front contact element, the spring element and the mounting element may be different areas of a one-part shaped body made of plastic by, for example, injection molding or 3D-printing.

Besides the back panel, the rack body of the pull-out rack typically comprises a vertically oriented front panel arranged at a horizontal distance to the back panel. Further, the pull-out rack may comprise two upper front adapters and two lower front adapters. The front panel, at its front side, may then comprise at least one laterally extending upper groove and at least one laterally extending lower groove, and a pair of laterally elongated upper through-holes at a ground of the at least one upper groove, and a pair of laterally elongated lower through-holes at a ground of the at least one lower groove. The at least one upper groove and the pair of laterally elongated upper through-holes are configured to receive parts of the two upper front adapters and to linearly guide the two upper front adapters in lateral direction. Similarly, the at least one lower groove and the pair of laterally elongated lower through-holes are configured to receive parts of the two lower front adapters and to linearly guide the two lower front adapters in lateral direction. Each of the upper and the lower front adapters may then be configured to be fixed to the front panel in a laterally adjusted position by means of one or more fixing screws whose heads abut against the back side of the front panel. Thus, the front adapters to which a decorative front of the cabinet may be attached can be moved in lateral direction in order to adjust the lateral position of the decorative front with respect to the front frame.

Each of the upper and the lower front adapters may have a support plate including a threaded bushing protruding into the respective laterally elongated though-hole and one circular through-hole on each lateral side of the threaded bushing. An adjustment screw screwed into the threaded bushing defines a pivot point with its front end. This pivot point can be moved in the pull-out direction by turning the adjustment screw by means of a tool engaging a back end of the adjustment screw provided with a tool engagement surface. A supporting plate of the respective front adapter, with its back side, abuts against a front side of the support plate, particularly against the pivot point defined by the adjustment screw. The supporting plate has two threaded bushings each protruding through one of the two circular through-holes in the support plate and receiving one of the fixing screws. By screwing the two fixing screws in the two threaded bushings in different directions, the supporting plate is tilted with respect to the support plate about a vertical tilting axis extending through the pivot point. Thus, in the area of each front adapter, the position of the decorative front of the cabinet can be adjusted in the pull-out direction by means of the adjustment screw, and the orientation of the front about vertical axes can be defined by means of the fixing screws. Further, an option of adjusting the vertical position of the decorative front may be provided in that each supporting plate may have a vertically elongated mounting hole for the decorative front. If this vertically elongated mounting hole is provided in a cantilever laterally protruding beyond the front plate, it is easily accessible from the back side for passing a fixing screw through the vertically elongated mounting hole.

The pull-out rack may have at least one shelf having a back end and a front end. The back end of the at least one shelf may be vertically supported at the back panel by means of a pair of back supporting pins fitting into blind holes provided in a front side of the back panel. Similarly, the front end of the at least one shelf may be vertically supported by means of a pair of front supporting pins fitting into blind holes provided in a back side of the front panel. More particularly, there may be at least two vertical rows of the blind holes in the front side of the back panel and at least two vertical rows of the blind holes in the back side of the front panel which allow for supporting the at least one shelf by means of the supporting pins at different heights at the back panel and at the front panel. There may even be more than two vertical rows of blind holes in the front side of the back panel and the back side of the front panel so that shelves of different widths may be supported by means of the supporting pins fitting into the blind holes.

The at least one shelf may have a shelf panel and a pair of bent metal sheets fixed to the shelf panel. For example, the bent metal sheets may be fixed to the shelf panel by at least one of clueing and fixing screws. The bent metal sheets may be configured and arranged such as to enclose those edges of the shelf panel that extend in the pull-out direction between the back panel and the front panel and such as to upwardly protrude beyond the shelf panel to provide a lateral enclosure for the upper surface of the shelf panel.

The supporting pins vertically supporting the at least one shelf may fit into seats provided at a bottom side of the at least one shelf. These seats may be laterally delimited by upwardly or downwardly bent sections of the bent metal sheets. If the seats are laterally delimited by downwardly bent sections of the bent metal sheets, there is no need to machine the shelf panel for providing the seats.

The back panel, the front panel and the shelf panel of the at least one shelf may be made of wood. Here, the term wood refers to any wood material inclusive of wood-based materials like fiber board, particle board or strand board.

The rack body of the pull-out rack may be stabilized in that back connecting screws are screwed through the back panel into the shelf panel; and front connecting screws are screwed through the front panel into the shelf panel of the at least one shelf. Particularly, there may be at least one upper shelf and at least one lower shelf which are fixed to the back panel and the front panel by means of such connecting screws.

Further, rails made of metal and screwed to the back panel and the front panel may extend along those edges of the shelf panel of the at least one shelf that are enclosed by the bent metal sheets. These rails extend above the bent metal sheets.

As already indicated above, a plurality of shelves may extend between the back panel and the front panel at different heights.

The at least one pull-out rail of the pull-out rack may be equipped with a damper slowing down the pull-out movement of the rack body when reaching its outmost pulled-out position. Additionally or alternatively, a damper may be provided for slowing down the movement of the rack body when reaching its pushed-in storage position within the cabinet. Further, the at least one pull-out rail may comprise a spring-operated opening device pushing the rack body out of the cabinet when activated, and a spring-operated pull-in device fully pulling the rack body into its storage position in the cabinet when approaching the storage position from outside the cabinet. At least one of these devices may be provided. Additionally or alternatively, the at least one pull-out rail may comprise an electric motor for electrically driving the movement of the rack body out of its storage position within the cabinet into its outmost position outside the cabinet and back into the cabinet.

Referring now in greater detail to the drawings, FIG. 1 shows a pull-out rack 1 mounted in a cabinet 2 but pulled out of the cabinet 2 into its outmost position in which objects arranged on shelves 3 to 6 of the pull-out rack 1 are easily accessible. The cabinet 2 comprises a bottom wall 7 hardly visible in FIG. 1, a pair of side walls 8 and 9, a top wall 10, a front frame 11 and a decorative front 12. The front frame 11 encloses a front opening 13 of the cabinet 2, and it protrudes inwards from the side walls 8 and 9 and also from the bottom wall 7 and the top wall 10. The decorative front 12 is mounted to the pull-out rack 12 and closes the front opening 13 when the pull-out rack 1 is in a storage position within the cabinet 2. The pull-out rack 1 comprises a rack body 14 and a pair of pull-out rails 15. By means of the two pull-out rails 15, only one of which being visible in FIG. 1, the rack body 14 is mounted to the bottom wall 7 of the cabinet 2 such that it can be pulled out of the cabinet 2 through the front opening 13 in the front frame 11. In this movement, the pull-out rails 15 only guide the bottom of the rack body 14. The top of the rack body 14 which is quite far away from the pull-out rails 15 is not directly guided by pull-out rails during the pull-out movement so that it might laterally move with respect to the side walls 8 and 9 of the cabinet 2. This movement is suppressed by a pair of stabilizers 16 and 17 which are mounted to an upper end 18 of a vertically oriented back panel 19 of the rack body 14.

Figure 2:
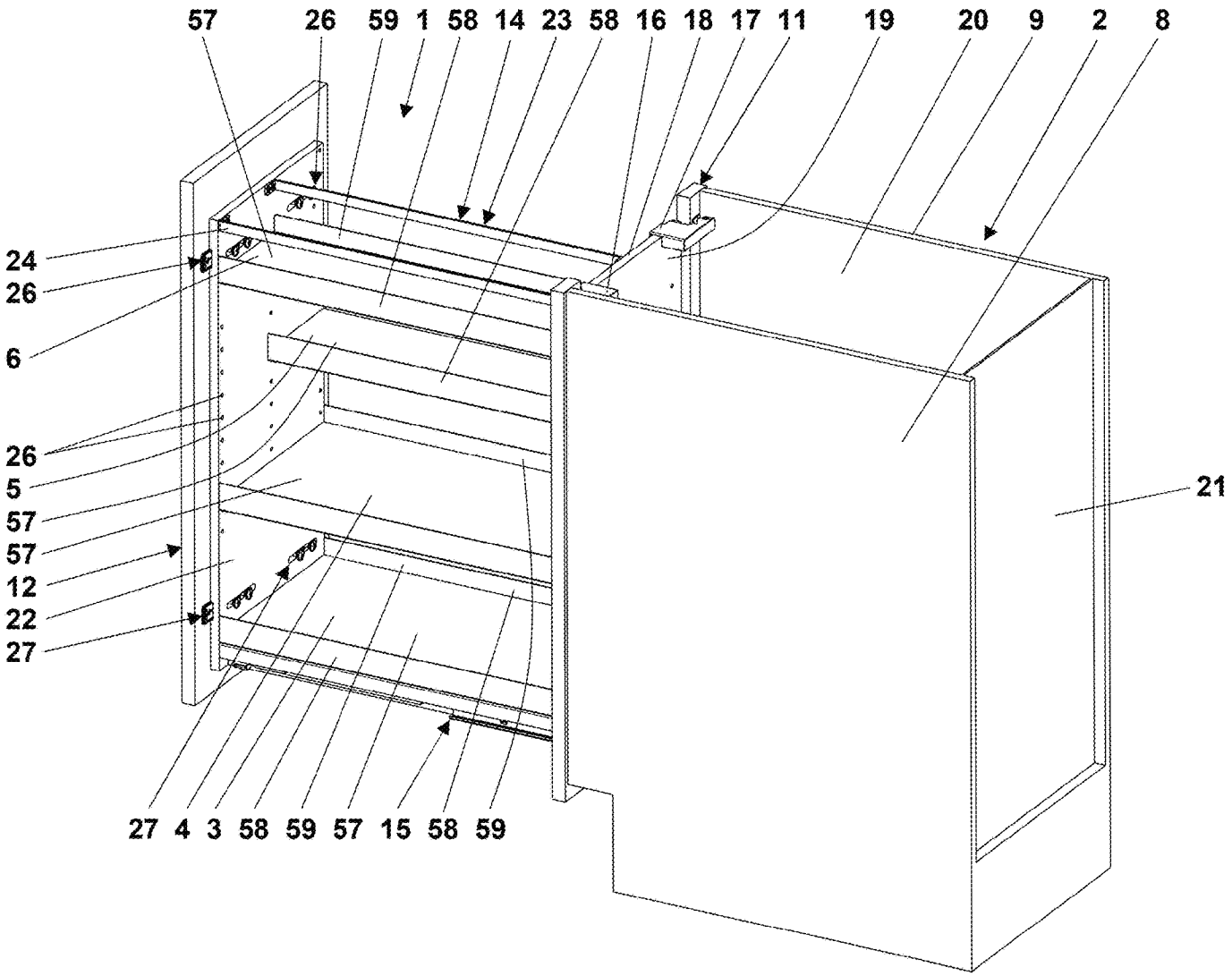
FIG. 2 is an isometric perspective back view of the cabinet with the pulled-out pull-out rack of FIG. 1, in which a top wall of the cabinet is removed so that the back side of the pull out-out rack is visible.

FIG. 2 in which the top wall 10 and the upper crossbeam of the front frame 11 have been removed for a better view on the back side of the pull-out rack 1 shows that the stabilizers 16 and 17 laterally protrude beyond the back panel 19 and contacts the side walls 8 and 9 to laterally support the upper end 18 of the back panel 19 at the side walls 8 and 9. Further details of the stabilizers 16 and 17 will be described with reference to FIGS. 3 and 4. FIG. 2 shows that the interior 20 of the cabinet 2 is delimited at the backside of the cabinet 2 by a back wall 21. Further, the distance over which the front frame 11 of the cabinet 2 inwardly protrudes from the side walls 8 and 9 is visible. The rack body 14 of the pull-out rack 1 comprises a vertically oriented front panel 22 arranged at a distance in the pull-out direction of the pull-out rails 15 to the back panel 19. The shelves 3 to 6 extend over this distance between the back panel 19 and the front panel 22. This distance is also covered by rails 23 and 24 extending along the edges of the uppermost shelf 6 at the top of the rack body 14. The rails 23 and 24 are made of metal and screwed to the back panel 19 and front panel 22. The shelves 3 to 6 may also be screwed to the back panel 19 and the front panel 22. However, parallel vertical rows of blind holes 25 and 26 are provided in the back panel 19 and the front panel 22, respectively. These blind holes 25 and 26 are configured to receive supporting pins for supporting the two shelves 4 and 5 at intermediate heights of the rack body 14 selected by the blind holes 25 and 26 into which the supporting pins are inserted. The decorative front 12 of the cabinet 2 is mounted to the front panel 22 of the pull-out rack 1 via adjustable upper front adapters 26 and adjustable lower front adapters 27.

Figure 3:
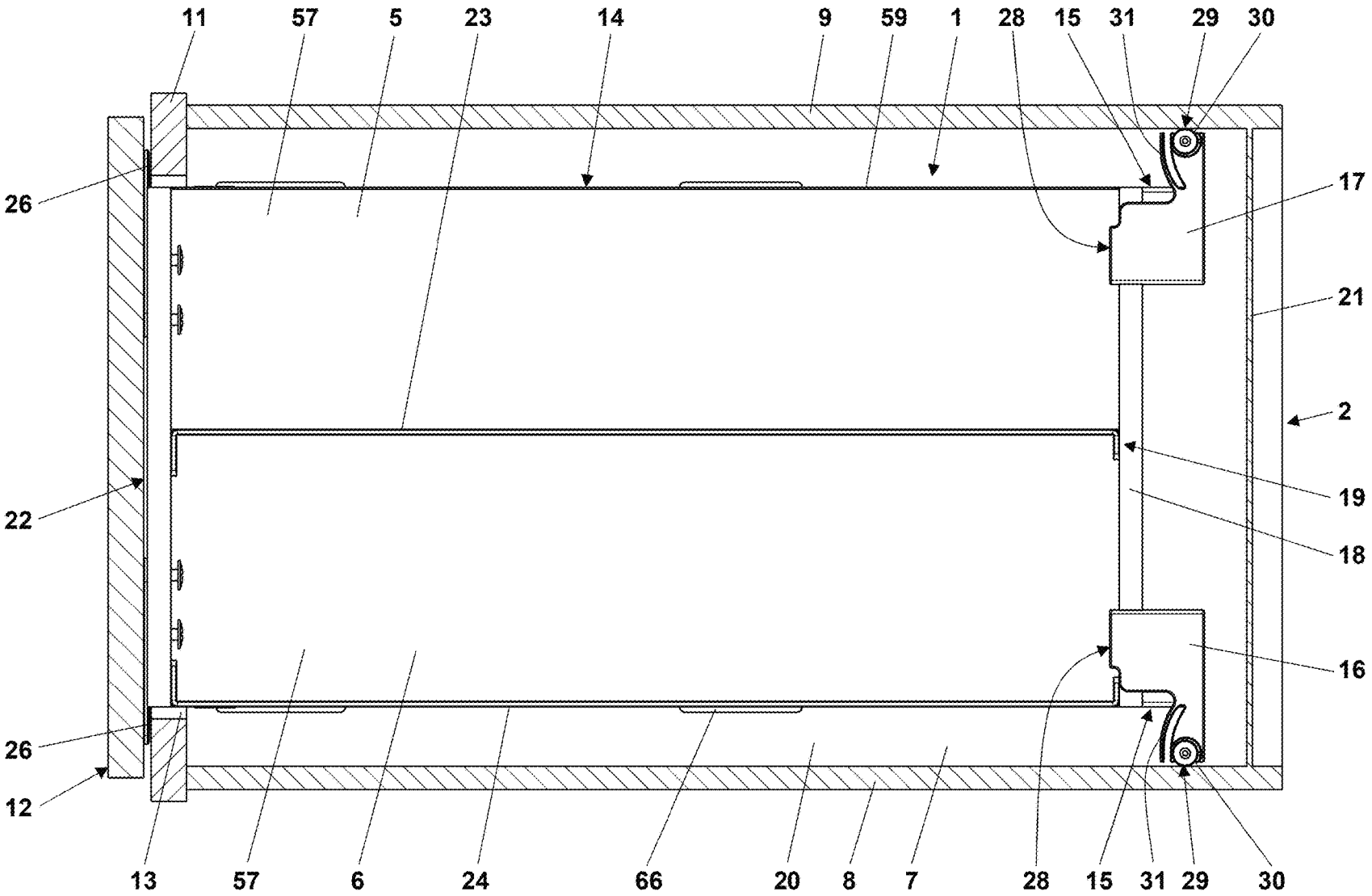
FIG. 3 is a top view of the cabinet of FIGS. 1 and 2 with the pull-out rack being in a pushed-in position, in which the top wall of the cabinet is removed like in FIG. 2.

FIG. 3 shows the pull-out rack 1 in its storage position within the cabinet 2. In this storage position, the decorative front 12 closes the front opening 13 of the front frame 11. In FIG. 3, it is well visible that the stabilizers 16 and 17 each have a mounting end 28 mounted to the upper end 18 of the back panel 19, and a moving contact end 29 that laterally protrudes from the back panel 19 and contacts the side wall 8 or 9, respectively. The moving contact ends 29 are defined by rollers 30 which are freely rotatable about vertical rotating axes and roll over the inner surfaces of the side walls 8 and 9. Further, the stabilizers 16 and 17 include impact dampers 31 which dampen an impact of the stabilizers 16 and 17 on the front frame 11 when the rack body 14 of the pull-out rack 1 reaches its outmost position according to FIGS. 1 and 2. Whereas a hard impact of the stabilizers 16 and 17 on the front frame 11 is not wanted, a contact of the stabilizers 16 and 17 at the upper end 18 of the back panel 19 with the front frame 11 in the outmost position of the pull-out rack 1 is desired as this contact stabilizes the back panel 19 and thus the entire back body 14 against tilting out of the cabinet 2.

Figure 4:
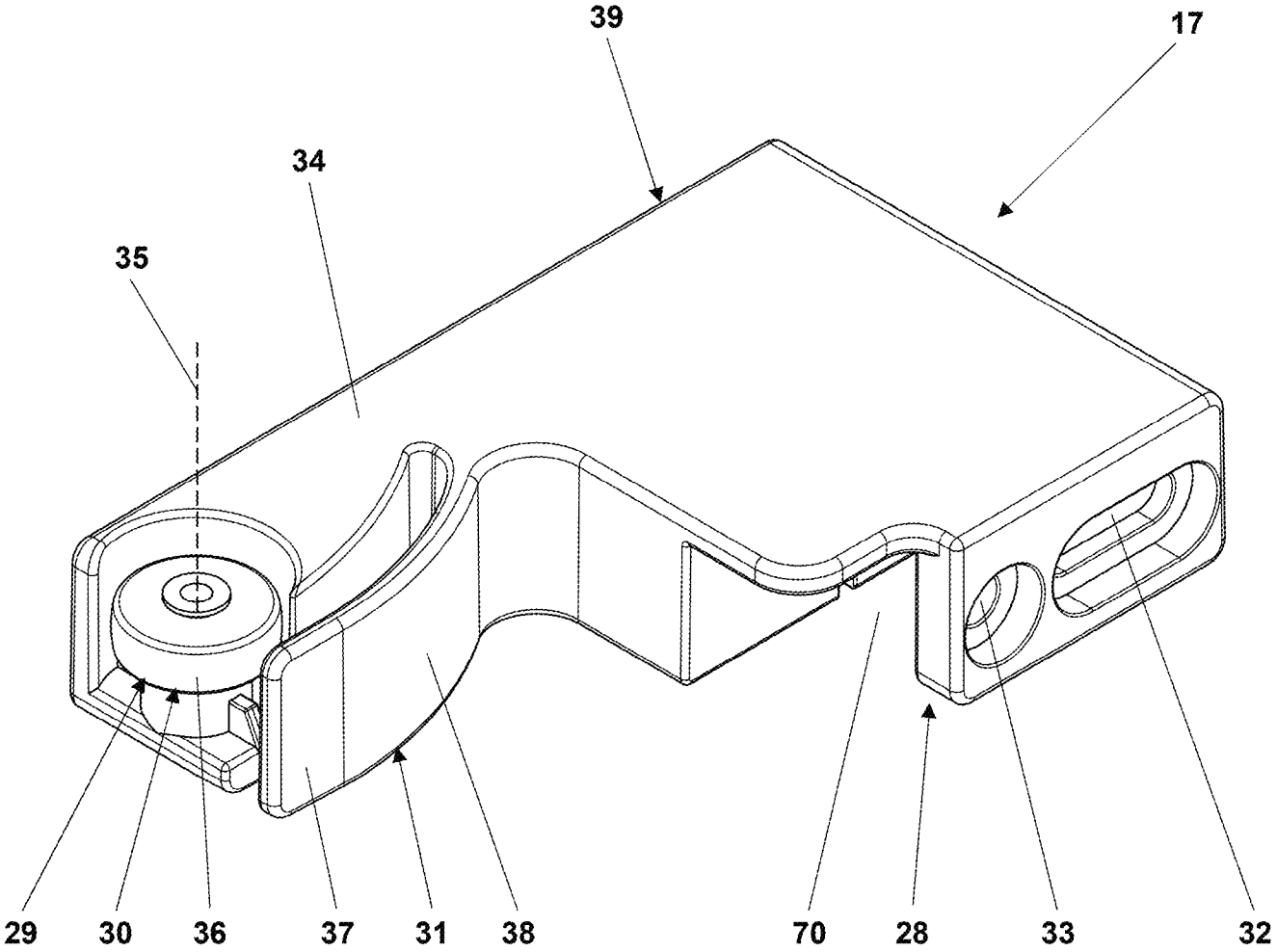
FIG. 4 shows a stabilizer of a pair of stabilizers of the pull-out rack of FIGS. 1 to 3 in a perspective view.

FIG. 4 in which the stabilizer 17 is depicted at an enlarged scale shows that the mounting end 28 is provided with a downwardly open and laterally extending channel 70 for receiving the upper end 18 of the back panel 19. Further, the mounting end 28 comprises an elongated hole 32 for a first fixing screw and a circular hole 33 for a second fixing screw. The elongated hole 32 allows for attaching the mounting end 28 to the upper end 18 of the back panel 19 and securing the mounting end 28 to that upper end by the first fixing screw but still allows for some lateral sliding movement of the stabilizer 17 within the limits of the elongated hole 32. Once the stabilizer 17 has reached its final working position in which its moving contact end 29 defined by the roller 30 contacts the side wall 9, the mounting end 28 can be completely fixed to the upper end 18 of the back panel 19 by means of second fixing screw passing through the circular hole 33. From the mounting end 28, a stabilizer arm 34 extends towards the moving contact end 29. The roller 30 is mounted to the stabilizers arm 34 at the moving contact end such as to freely rotate about the vertical axis 35. The Roller 30 has a soft elastic roller shell 36 for contacting the side wall 9 in a silent way, i.e. without rattling. The impact damper 31 is arranged at a front side of the stabilizer arm 34. It includes a front contact element 37 and a spring element 38 elastically supporting the front contact element 37 at the mounting end 28. The front contact element 37, the spring element 38, the stabilizer arm 34 and the mounting end 28 are different parts of a one-part shaped body 39 which may, for example be injection molded or 3D-printed of plastic. The roller 30 is the only separate part mounted to this one-part shaped body 39.

Figure 5:
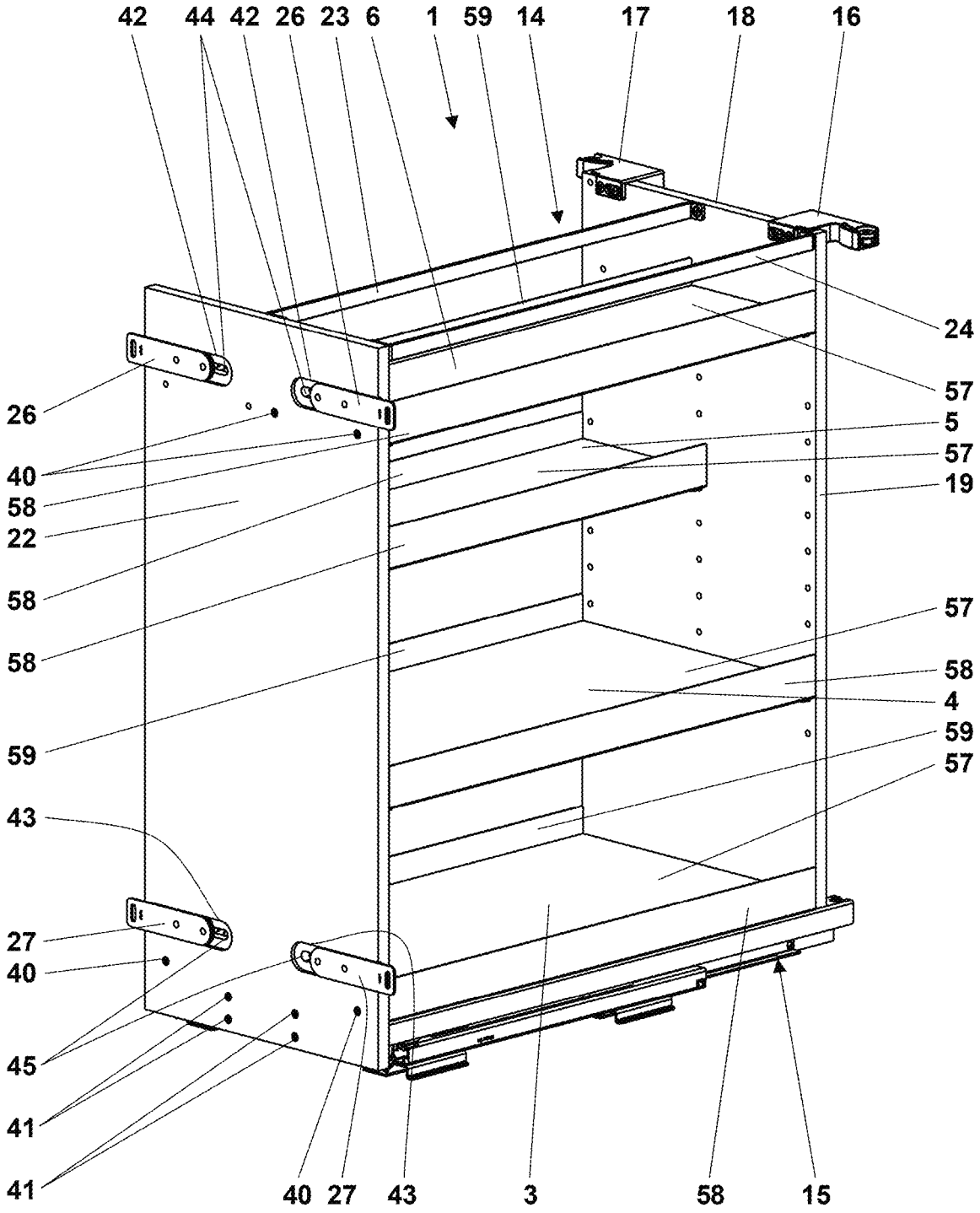
FIG. 5 shows the pull-out rack of FIGS. 1 to 3 without the cabinet but inclusive of its pull-out rails in their pushed-in state.

FIG. 5 separately shows the pull-out rack 1 without the cabinet 2 so that the front side of the front panel 22 of the rack body 14 is visible. Fixing screws 40 extend through the front panel 22 for fixing the lowermost shelf 3 and the uppermost shelf 6 to the front panel 22. Further fixing screws 41 fix the front panel 22 to a guided bracket to which the pull-out rails 15 are mounted. Further, FIG. 5 shows two laterally extending upper grooves 42 for guiding the upper front adapters 26 and two laterally extending lower grooves 43 for guiding the lower front adapters 27. At the grounds of the upper grooves 42, laterally elongated upper through holes 44 pass through the front panel 22, and, at the grounds of the lower grooves 43, laterally elongated lower through holes 45 pass through the front panel 22.

Figure 6:
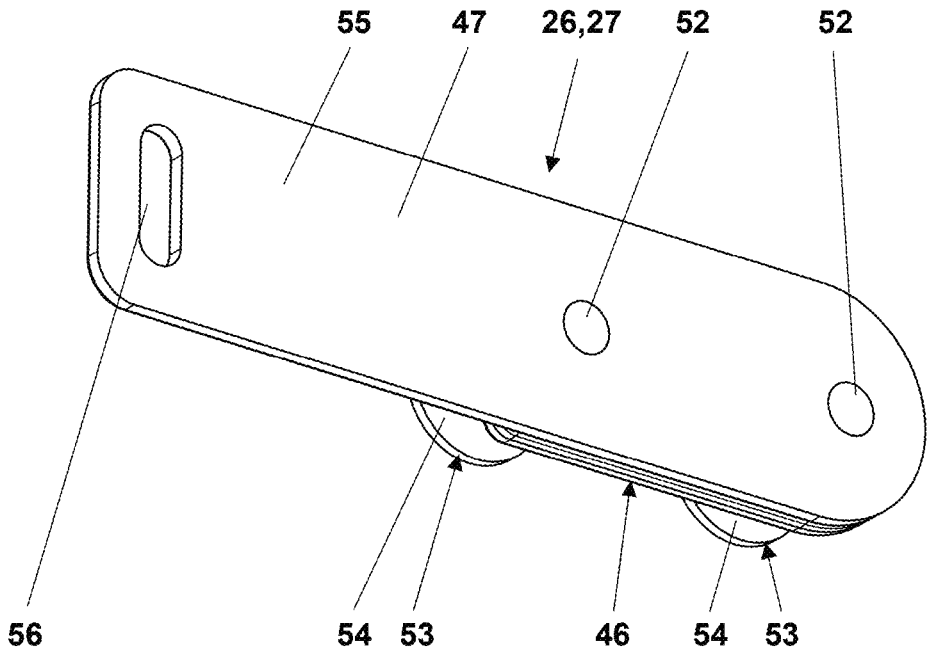
FIG. 6 is a perspective front view of a front adapter of the pull-out rack of FIG. 5.
Figure 7:
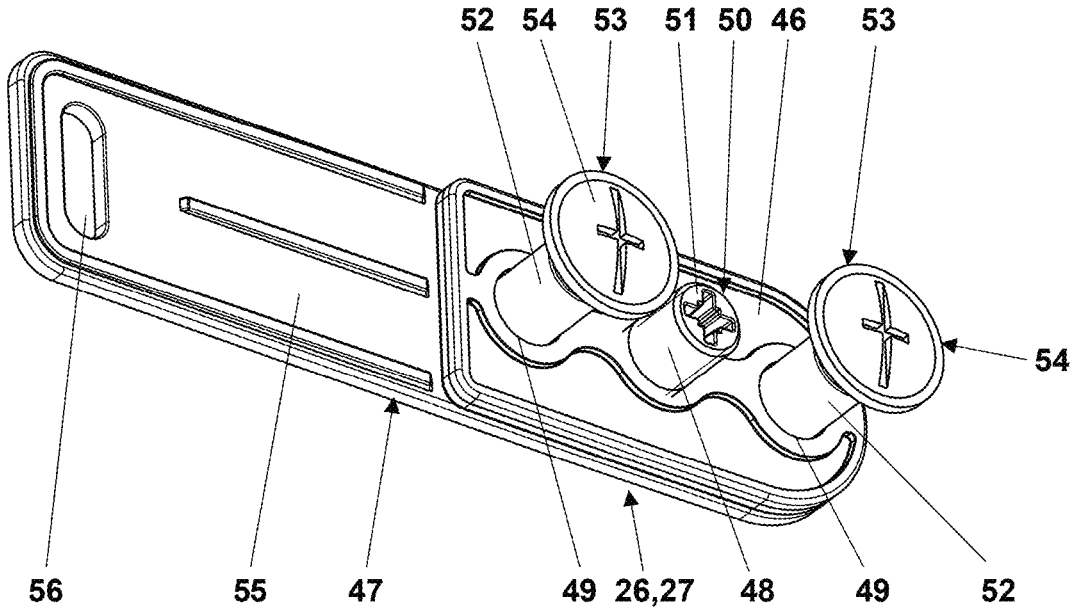
FIG. 7 is a back view of the front adapter of FIG. 6.

The front adapters 26 and 27, one of which being depicted in FIG. 6 in a perspective front view and in FIG. 7 in a perspective back view, each comprise a support plate 46 and a supporting plate 47. When the respective front adapter 26 or 27 is mounted to the front panel 22, the support plate 46 is partially received in and guided by the respective groove 42 or 43. The support plate 46 includes a threaded bushing 48 protruding into the respective laterally elongated through hole 44 or 45, and one circular through hole 49 on each lateral side of the threaded bushing 48. An adjustment screw 50 is screwed into the threaded bushing 48. The adjustment screw has a front end facing the supporting plate 47 and defining a pivot point for the supporting plate, and a back end 51 with a tool engagement surface in form of a cross recess. With its backside, the supporting plate 47 abuts against the front side of the support plate 46. The supporting plate 47 comprises two threaded bushings 52 each protruding through one of the circular through holes 49 in the support plate 46 and receiving one of two fixing screws 53. When the front adapters 26 and 27 are mounted to the front panel 22, screw heads 54 of the fixing screws 53 abut against the back side of the front panel 22. The threaded bushings 52 passing through the circular through holes 49 in the support plate 46 and the elongated hole 44 or 45 in the front panel 22 with little play effectively limit the pivot point for the supporting plate 59 defined by the front end of the adjustments screw 50 to a vertical pivot axis. By means of screwing the adjustment screw 50 and the two fixing screws 53 in and out, the position and orientation of the supporting plate 47 with respect to the support plate 46 can be adjusted. The support plate 47 includes a cantilever 55 comprising a vertically elongated mounting hole 56 at its free end. When the front adapters 26 and 27 are mounted to the front panel 22, the cantilevers 55 laterally protrude beyond the front panel 22, and the vertically elongated mounting hole 56 allows for mounting the decorative front 12 at a variable height by means of fixing screws passing through the elongated mounting holes 56.

Figure 8:
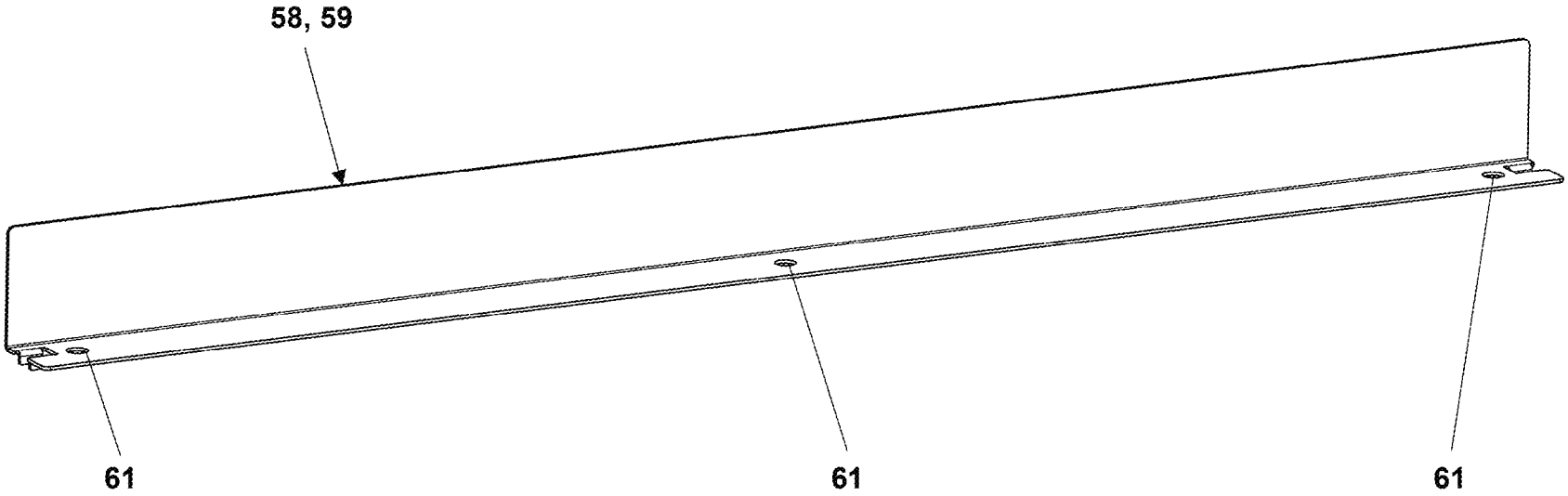
FIG. 8 shows a bent metal sheet of a shelf of the pull-out rack according to FIGS. 1 to 3 and 5.
Figure 9:
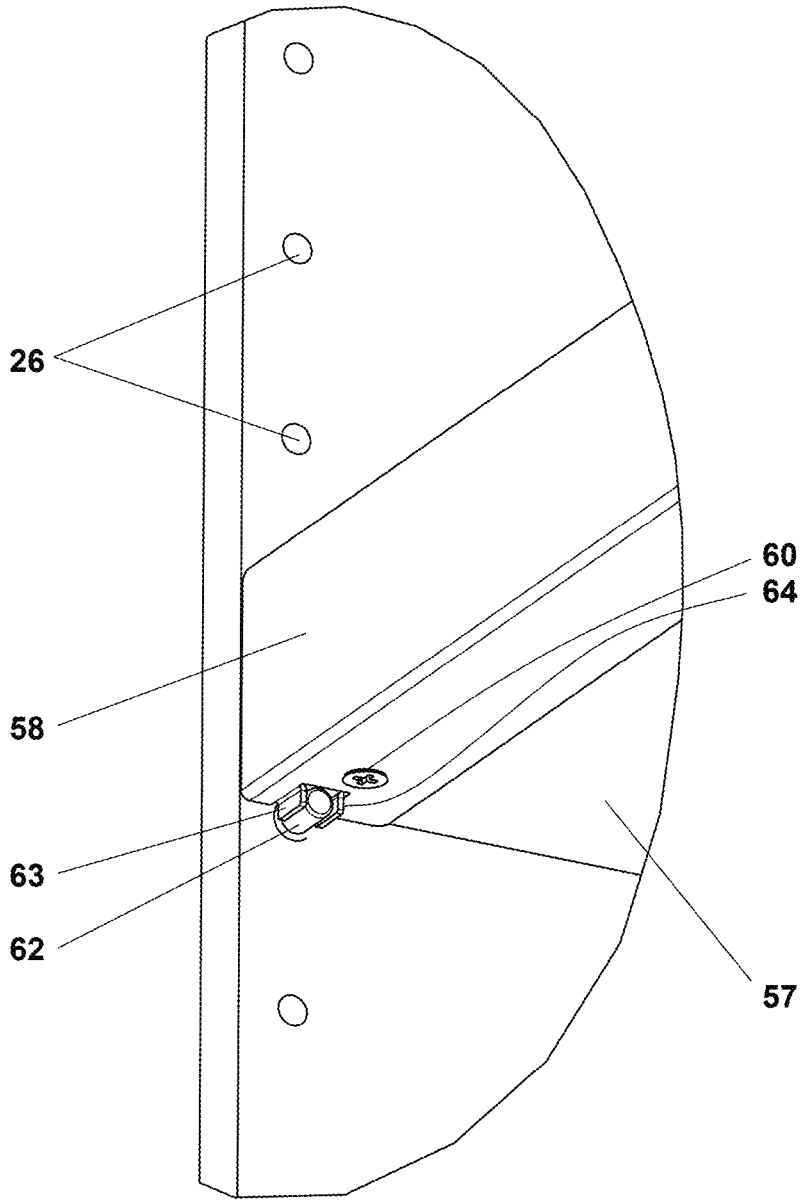
FIG. 9 depicts a detail of a shelf supported at a back panel of the pull-out rack of FIGS. 1 to 3 and 5.

The shelves 3-6 depicted in FIGS. 1-3 and 5 each comprise a shelf panel 57 and a pair of bent metal sheets 58 and 59. The bent metal sheets 58 and 59 each have a L-shaped cross section and each enclose one of the longitudinal edges of the respective shelf panel 57 extending between the back panel 19 and the front panel 22 of the rack body 14. The bent metal sheets 58 and 59 are fixed to the respective shelf panel via fixing screws 60 passing through screw holes 61 in their horizontal branch, see FIGS. 8 and 9. Additionally or alternatively, the bent metal sheets 58, 59 may be glued to the shelf panels 57. The shelves panels 57 may be made of wood material, and the fixing screws 40 may be directly screwed into the shelf panels 57. The shelf panels 57 may be simple rectangularly cut panels which need little or even no further processing. Even seats for the supporting pins 62, see FIG. 9, may be defined by the unprocessed bottom side of the respective shelf panel 57 in combination with downwardly bent sections 63 and 64 of the bent metal sheets 58, 59.

Figure 10:
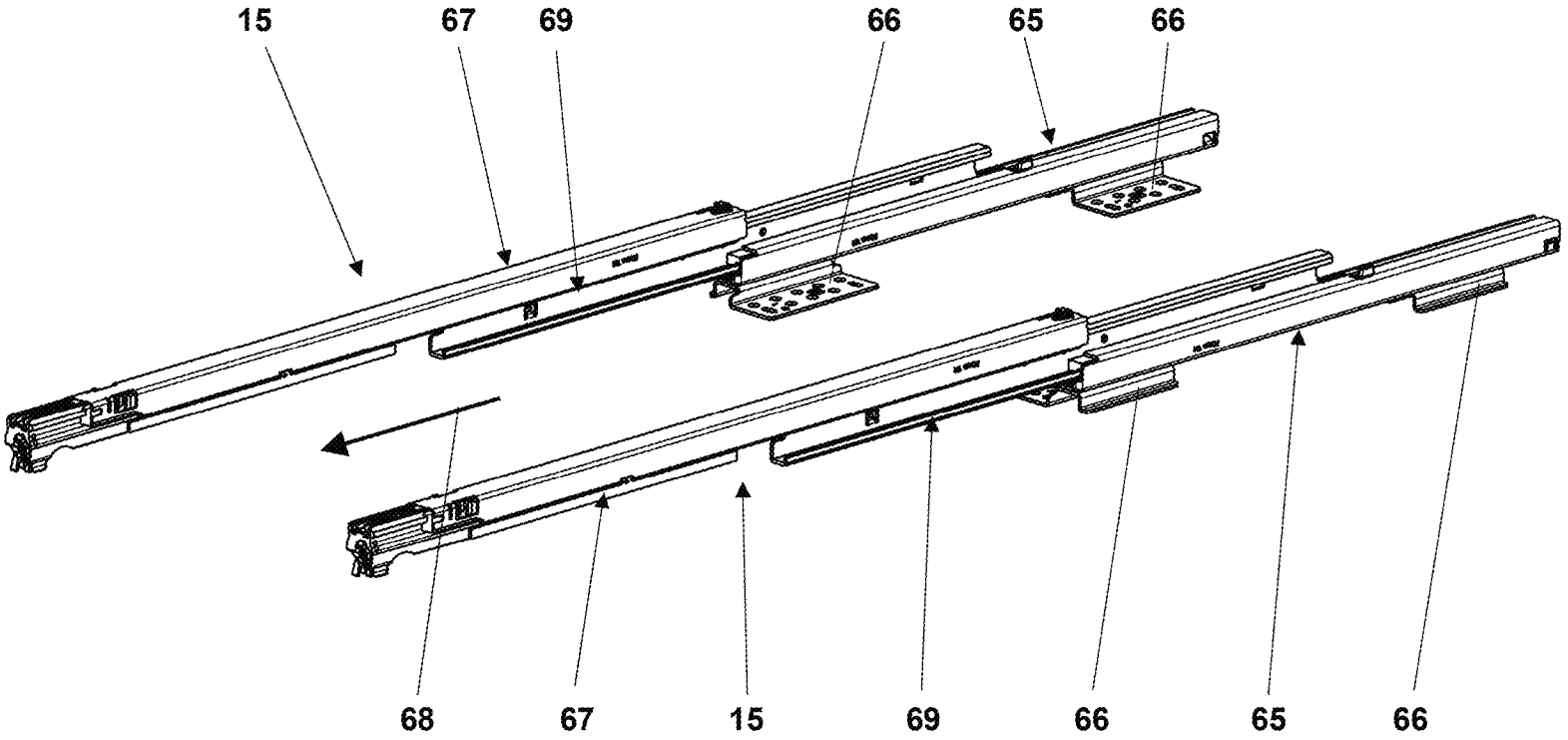
FIG. 10 separately shows the pull-out rails of the pull-out rack according to FIGS. 1 to 3 and 5 in their pulled-out state.

FIG. 10 shows the pair of the pull-out rails 15 in their pulled-out states. Each of the pull-out rails 15 comprises a fixed rail 65 with fixation elements 66 to be fixed to the bottom wall 7 of the cabinet 2. Further, each of the pull-out rail comprises a guided rail 67 which is linearly guided in a pull-out direction 68 with respect to the fixed rail 65. The guided rail 67 is configured to be mounted to the guided bracket fixed to the bottom of the rack body 14. Additionally, each of the pull-out rail 15 comprises an intermediate rail 69 which is arranged between the fixed rail 65 and guided rail 67 in such a way that it elongates the pull-out path of the respective guided rail 67 in the pull-out direction 68 with respect to the fixed rail 65 such that the rack body 16 can be completely pulled out of the cabinet 2 until its back panel 19 flushes with the front frame 11, see FIG. 1.

Many variations and modifications may be made to the preferred embodiments of the invention without departing substantially from the spirit and principles of the invention. All such modifications and variations are intended to be included herein within the scope of the present invention, as defined by the following claims.

I claim:

1. A pull-out rack for being mounted in a cabinet having a bottom wall, a pair of side walls and a front frame enclosing a front opening and protruding inwards from the side walls, the pull-out rack comprising, at least one pull-out rail having a fixed rail and a guided rail, wherein the fixed rail is configured to be mounted to the bottom wall of the cabinet, and wherein the guided rail is linearly guided in a pull-out direction with respect to the fixed rail, a rack body mounted to the guided rail of the at least one pull-out rail, configured to pass through the front opening, and having a vertically oriented back panel which has an upper end, and a pair of stabilizers, wherein each stabilizer of the pair of stabilizers has a mounting end and a moving contact end, and wherein each stabilizer of the pair of stabilizers is configured to be mounted to the upper end of the back panel of the rack body with its mounting end being in a working position in which its moving contact end laterally protrudes from the back panel and contacts one of the side walls of the cabinet, wherein each stabilizer of the pair of stabilizers comprises:

a stabilizer arm extending from its mounting end towards its moving contact end, and a roller mounted to the stabilizer arm at the moving contact end such as to freely rotate about a vertical axis and to contact the side wall in the working position of the stabilizer.

2. The pull-out rack of claim 1, wherein the roller of each stabilizer of the pair of stabilizers has an elastic roller shell.

3. The pull-out rack of claim 1, wherein the rack body further comprises a vertically oriented front panel arranged at a horizontal distance to the back panel.

4. A pull-out rack for being mounted in a cabinet having a bottom wall, a pair of side walls and a front frame enclosing a front opening and protruding inwards from the side walls, the pull-out rack comprising, at least one pull-out rail having a fixed rail and a guided rail, wherein the fixed rail is configured to be mounted to the bottom wall of the cabinet, and wherein the guided rail is linearly guided in a pull-out direction with respect to the fixed rail, a rack body mounted to the guided rail of the at least one pull-out rail, configured to pass through the front opening, and having a vertically oriented back panel which has an upper end, and a pair of stabilizers, wherein each stabilizer of the pair of stabilizers has a mounting end and a moving contact end, and wherein each stabilizer of the pair of stabilizers is configured to be mounted to the upper end of the back panel of the rack body with its mounting end being in a working position in which its moving contact end laterally protrudes from the back panel and contacts one of the side walls of the cabinet, wherein each stabilizer of the pair of stabilizers comprises an impact damper which is arranged at a front side of the stabilizer laterally protruding from the back panel in the working position of the stabilizer, and which is configured to dampen an impact of the stabilizer on the front frame.

5. The pull-out rack of claim 4, wherein the impact damper comprises a front contact element arranged to impact on the front frame, and a spring element elastically supporting the front contact element at the mounting end.

6. The pull-out rack of claim 5, wherein the front contact element, the spring element and the mounting end are different areas of a one-part shaped body made of plastic.

7. A pull-out rack for being mounted in a cabinet having a bottom wall, a pair of side walls and a front frame enclosing a front opening and protruding inwards from the side walls, the pull-out rack comprising, at least one pull-out rail having a fixed rail and a guided rail, wherein the fixed rail is configured to be mounted to the bottom wall of the cabinet, and wherein the guided rail is linearly guided in a pull-out direction with respect to the fixed rail, a rack body mounted to the guided rail of the at least one pull-out rail, configured to pass through the front opening, and having a vertically oriented back panel which has an upper end, and a pair of stabilizers, wherein each stabilizer of the pair of stabilizers has a mounting end and a moving contact end, and wherein each stabilizer of the pair of stabilizers is configured to be mounted to the upper end of the back panel of the rack body with its mounting end being in a working position in which its moving contact end laterally protrudes from the back panel and contacts one of the side walls of the cabinet, wherein:

the rack body further comprises a vertically oriented front panel arranged at a horizontal distance to the back panel, the pull-out rack further comprises two upper front adapters and two lower front adapters, the front panel, at its front side, comprises at least one laterally extending upper groove and at least one laterally extending lower groove, and a pair of laterally elongated upper through-holes at a ground of the at least one upper groove and a pair of laterally elongated lower through-holes at a ground of the at least one lower groove, the at least one upper groove and the pair of laterally elongated upper through-holes are configured to receive parts of the two upper front adapters and to linearly guide the two upper front adapters in a lateral direction, the at least one lower groove and the pair of laterally elongated lower through-holes are configured to receive parts of the two lower front adapters and to linearly guide the two lower front adapters in a lateral direction, and each of the upper and the lower front adapters is configured to be fixed to the front panel in a laterally adjusted position by means of one or more fixing screws whose heads abut against the back side of the front panel.

8. The pull-out rack of claim 7, wherein each of the upper and the lower front adapters has a support plate including a threaded bushing protruding into the respective laterally elongated hole and one circular through-hole on each lateral side of the threaded bushing, an adjustment screw screwed into the threaded bushing and having a front end defining a pivot point and a back end with a tool engagement surface, a supporting plate abutting with its back side against a front side of the support plate and including two threaded bushings each protruding through one of the two circular through-holes in the support plate and receiving one of the fixing screws, and a vertically elongated mounting hole in a cantilever laterally protruding beyond the front panel.

9. A pull-out rack for being mounted in a cabinet having a bottom wall, a pair of side walls and a front frame enclosing a front opening and protruding inwards from the side walls, the pull-out rack comprising, at least one pull-out rail having a fixed rail and a guided rail, wherein the fixed rail is configured to be mounted to the bottom wall of the cabinet, and wherein the guided rail is linearly guided in a pull-out direction with respect to the fixed rail, a rack body mounted to the guided rail of the at least one pull-out rail, configured to pass through the front opening, and having a vertically oriented back panel which has an upper end, and a pair of stabilizers, wherein each stabilizer of the pair of stabilizers has a mounting end and a moving contact end, and wherein each stabilizer of the pair of stabilizers is configured to be mounted to the upper end of the back panel of the rack body with its mounting end being in a working position in which its moving contact end laterally protrudes from the back panel and contacts one of the side walls of the cabinet, wherein:

the rack body further comprises a vertically oriented front panel arranged at a horizontal distance to the back panel, the pull-out rack; further comprises:

at least one shelf having a back end and a front end, a pair of back supporting pins fitting into blind holes in a front side of the back panel and vertically supporting the at least one shelf at its back end, and a pair of front supporting pins fitting into blind holes in a back side of the front panel and vertically supporting the at least one shelf at its front end.

10. The pull-out rack of claim 9, wherein there are at least two vertical rows of the blind holes in the front side of the back panel and at least two vertical rows of the blind holes in the back side of the front panel.

11. The pull-out rack of claim 9, wherein the at least one shelf has a shelf panel and a pair of bent metal sheets fixed to the shelf panel, wherein the bent metal sheets enclose those edges of the shelf panel that extend between the back panel and the front panel, and upwardly protrude beyond the shelf panel.

12. The pull-out rack of claim 11, wherein the supporting pins fit into seats at a bottom side of the at least one shelf, wherein the seats are laterally delimited by upwardly or downwardly bent sections of the bent metal sheets.

13. The pull-out rack of claim 11, wherein the back panel, the front panel and the shelf panel of the at least one shelf are made of wood.

14. The pull-out rack of claim 11, wherein back connecting screws are screwed through the back panel into the shelf panel, and wherein front connecting screws are screwed through the front panel into the shelf panel of the at least one shelf.

15. The pull-out rack of claim 11, wherein rails made of metal and screwed to the back panel and the front panel extend along those edges of the shelf panel of the at least one shelf that are enclosed by the bent metal sheets and above the bent metal sheets.

16. The pull-out rack of claim 9, wherein a plurality of shelves extend at different heights between the back panel and the front panel.

* * * * *